US012703561B2

(12) United States Patent
Hodges

(10) Patent No.: US 12,703,561 B2
(45) Date of Patent: Aug. 11, 2026

(54) COLLATION OF PACKAGES AND METHOD OF RETAINING PACKAGES TOGETHER IN A COLLATION

(71) Applicant: British American Tobacco (Investments) Limited, London (GB)

(72) Inventor: Paul Hodges, London (GB)

(73) Assignee: British American Tobacco (Investments) Limited, London (GB)

( * ) Notice: Subject to any disclaimer, the term of this patent is extended or adjusted under 35 U.S.C. 154(b) by 55 days.

(21) Appl. No.: 18/560,120

(22) PCT Filed: May 11, 2022

(86) PCT No.: PCT/GB2022/051192
§ 371 (c)(1),
(2) Date: Nov. 10, 2023

(87) PCT Pub. No.: WO2022/238695
PCT Pub. Date: Nov. 17, 2022

(65) Prior Publication Data

US 2024/0239594 A1 Jul. 18, 2024

(30) Foreign Application Priority Data

May 13, 2021 (GB) ..... 2106874

(51) Int. Cl.
*B65D 85/10* (2006.01)
*B65D 63/10* (2006.01)
*B65D 77/32* (2006.01)

(52) U.S. Cl.
CPC ..... *B65D 85/1072* (2013.01); *B65D 63/1009* (2013.01); *B65D 77/32* (2013.01)

(58) Field of Classification Search
CPC ..... B65D 85/1045; B65D 63/1009; B65D 21/0205; B65D 71/0085; B65D 2563/101;
(Continued)

(56) References Cited

U.S. PATENT DOCUMENTS 4,079,566 A 3/1978 Stoecklin
5,605,897 A * 2/1997 Beasley, Jr. ..... A61K 31/551 514/220

(Continued)

FOREIGN PATENT DOCUMENTS

DE 19537829 A1 10/1996
WO 199400362 1/1994

OTHER PUBLICATIONS

PCT International Search Report and Written Opinion in International Application No. PCT/GB2022/051192, dated Aug. 3, 2022, 12 pages.

*Primary Examiner* — King M Chu

(74) *Attorney, Agent, or Firm* — MERCHANT & GOULD P.C.

(57) ABSTRACT

A collation of packages and related methods of retaining packages together in a collation wherein each package of the collation being cuboid-shaped and including a pair of opposing first faces, a pair of opposing second faces and a pair of opposing end faces. The packages are arranged in rows such that a second face of a package faces a second face of an adjacent package within the same row, and a first face of a package in a row faces a first face of a package in an adjacent row. A second face of a package at the end of each row, and a first face of each package in a row, being exposed. The collation includes a plurality of bands extending about the packages to hold the collation together. Each band is spaced from its adjacent band and extends over the exposed first face and exposed second face, of each package.

19 Claims, 7 Drawing Sheets

(58) Field of Classification Search
CPC .... B65D 71/063; B65D 71/38; B65D 77/003; B65D 77/32; B65D 85/1048; B65D 85/1072
USPC ..... 206/256, 264, 242, 261, 271, 265
See application file for complete search history.

(56) References Cited

U.S. PATENT DOCUMENTS

| | | | | | |
|---|---|---|---|---|---|
| 5,733,652 | A * | 3/1998 | Stowman | B65D 63/1009 | 428/218 |
| 6,338,410 | B1 * | 1/2002 | Wasmund | B65D 85/1072 | 206/778 |
| 8,910,782 | B2 * | 12/2014 | Koster | B65B 11/08 | 206/256 |
| 2006/0091025 | A1 * | 5/2006 | Focke | B65C 1/04 | 206/271 |
| 2014/0203018 | A1 * | 7/2014 | Kerep | B32B 5/26 | 156/60 |

* cited by examiner

COLLATION OF PACKAGES AND METHOD OF RETAINING PACKAGES TOGETHER IN A COLLATION

PRIORITY CLAIM

The present application claims priority to PCT Application No. PCT/GB2022/051192 filed May 11, 2022, which claims priority to GB Application No. 2106874.7, filed May 13, 2021, each of which is hereby incorporated by reference in their entirety.

TECHNICAL FIELD

The present invention relates to a collation of packages. A method of retaining packages together in a collation is also disclosed.

BACKGROUND

Known delivery systems, such as combustible and non-combustible aerosol provision systems and other tobacco industry products, are usually contained in packages. Often multiple packages are collated and placed in cartons. The cartons may be formed from cardboard or a similar material. Alternatively, the plurality of packages may be wrapped in plastic. The cartons and/or wrapping is opened to access individual packages.

SUMMARY

According to a first aspect of the present disclosure, there is provided a collation of cuboid-shaped packages, each package of the collation comprising a pair of opposing first faces, a pair of opposing second faces and a pair of opposing end faces, wherein the packages are arranged in rows such that a second face of a package faces a second face of an adjacent package within the same row, and a first face of a package in a row faces a first face of a package in an adjacent row, a second face of a package at the end of each row, and a first face of each package in a row, being exposed; and a plurality of bands extending about the packages to hold the collation together; wherein each band is spaced from its adjacent band and extends over the exposed first face and exposed second face, of each package.

According to another aspect of the present disclosure, there is provided a collation of packages, each package of the collation being cuboid-shaped and comprising a pair of opposing first faces, a pair of opposing second faces and a pair of opposing end faces, wherein the packages are arranged in a row such that a first face of a package faces a first face of an adjacent package in the row, a first face of a package at the end the row, and a second face of each package in the row, being exposed; and a plurality of bands extending about the packages to hold the collation together; wherein each band is spaced from its adjacent band and extends over the exposed first face and exposed second face, of each package.

The pair of opposing end faces of each package may comprise a top end face and a bottom end face, and wherein all the top end faces of the collation of packages may lie in a first plane, and the bottom end faces of the collation of packages may lie in a second plane, parallel to the first plane.

Preferably, each band of the plurality of bands may extend parallel to said first and second planes.

The plurality of bands may comprise a first band and a second band, said first band may be spaced from said first and second planes.

Optionally, the second band may be spaced from said first and second planes.

The plurality of bands may comprise a first band and a second band, said second band may be spaced from said first and second planes.

The plurality of bands may comprise a first band and a second band, wherein the first band may be contiguous with the first plane.

Optionally, the second band may be contiguous with the second plane.

The collation of packages may comprise a third band between said first and second bands.

Optionally, each package may comprise a wrapper and a tear strip for removal of the wrapper, wherein the plurality of bands may extend about said packages such that they do not overlie the tear strip.

Preferably, the plurality of bands may be equally spaced from one another.

Each band of the plurality of bands may be endless.

The plurality of bands may be strips or ribbons.

Preferably, the strips or ribbons may comprise a pressure-sensitive adhesive layer for releasable attachment to the collation of packages.

Each strip or ribbon may comprise a region of overlap.

Optionally, the strip or ribbon may be adhered to itself with peelable adhesive in the region of overlap, a tip portion of the region of overlap may be adhesive free to form a pull tab.

Preferably, at least one of the plurality of bands may be formed from a transparent material.

At least one of the plurality of bands may be formed from MOPP.

At least one of the plurality of bands may be formed from PET.

Optionally, the plurality of bands may each have a width between 1.6 mm and 20 mm, preferably between 5 mm and 15 mm, preferably around 8 mm.

The first face of each package may be a major face, and the second face of each package may be a minor face.

According to another aspect of the present disclosure, there is provided a method of holding a collation of cuboid-shaped packages together, the method comprising: providing a collation of packages, each package comprising a pair of opposing first faces, a pair of opposing second faces and a pair of opposing end faces, arranging the packages in rows such that a second face of a package faces a second face of an adjacent package within the same row, and a first face of a package in a row faces a first face of a package in an adjacent row, a second face of a package at the end of each row, and a first face of a package in a row being exposed; providing a plurality of bands; and positioning each band so that it is spaced from its adjacent band and extends over the exposed first face, and the exposed second faces, of each package.

According to another aspect of the present disclosure, there is provided a method of retaining packages together in a collation, the method comprising: providing a collation of cuboid-shaped packages, each package comprising a pair of opposing first faces, a pair of opposing second faces and a pair of opposing end faces, arranging the packages in a row such that a first face of a package faces a first face of an adjacent package in the row, a first face of a package at the end of the row, and a second face of a package in the row being exposed; providing a plurality of bands; and positioning each band so that it is spaced from its adjacent band and extends over the exposed first face, and the exposed second faces, of each package.

Each band may be endless and may be formed from a heat-sensitive material, the method may comprise heat shrinking each band once they have been positioned so as to extend over the exposed first faces and exposed second faces.

The plurality of bands may be strips or ribbons and the method may comprise attaching the strips or ribbons to the packages via an adhesive.

The packages may be packages for delivery systems. Optionally, the packages may also be packages for combustible products.

BRIEF DESCRIPTION OF THE DRAWINGS

So that the invention may be more fully understood, embodiments of the present invention will now be described, by way of example only, with reference to the accompanying drawings, in which.

DETAILED DESCRIPTION

As used herein the term "delivery system" is intended to encompass systems that deliver a substance to a user, and includes:

- combustible aerosol provision systems, such as cigarettes, cigarillos, cigars, and tobacco pipes or for roll-your-own cigarettes (whether based on tobacco, tobacco derivatives, expanded tobacco, reconstituted tobacco, tobacco substitutes or other smokeable material);
- non-combustible aerosol provision systems that release compounds from an aerosolizable material without combusting the aerosolizable material, such as electronic cigarettes, tobacco heating products, and hybrid systems to generate aerosol using a combination of aerosolizable materials;
- articles comprising aerosolizable material and configured to be used within one of these non-combustible aerosol provision systems; and
- aerosol-free delivery systems, such as lozenges, gums, patches, articles comprising inhalable powders, and smokeless tobacco products such as snus and snuff, which deliver a material to a user without forming an aerosol, wherein the material may or may not comprise nicotine.

According to the present disclosure, a "combustible" aerosol provision system is one where a constituent aerosolizable material of the aerosol provision system (or component thereof) is combusted or burned in order to facilitate delivery to a user.

According to the present disclose, a "non-combustible" aerosol provision system is one where a constituent aerosolizable material of the aerosol provision system (or component thereof) is not combusted or burned in order to facilitate delivery to a user.

Figure 1:
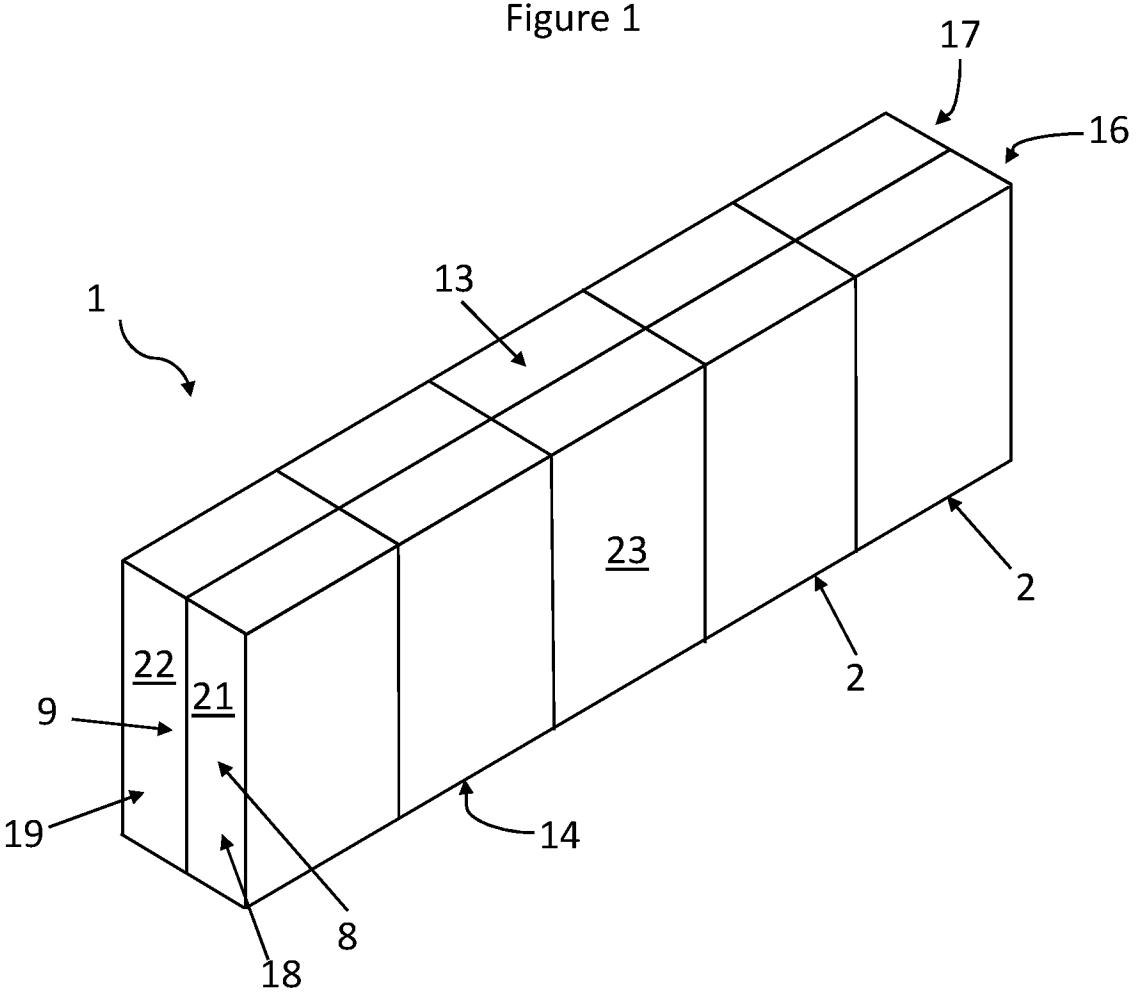
FIGS. 1 and 2 show a collation of packages for delivery systems without the band attached to the packages.

Referring to FIG. 1, there is shown a collation 1 of packages 2 for delivery systems (not shown). The collation 1 of packages 2 comprises a plurality of individual cuboid-shaped packages 2. An exemplary individual package 2 for delivery systems is shown in FIG. 3.

Figure 3:
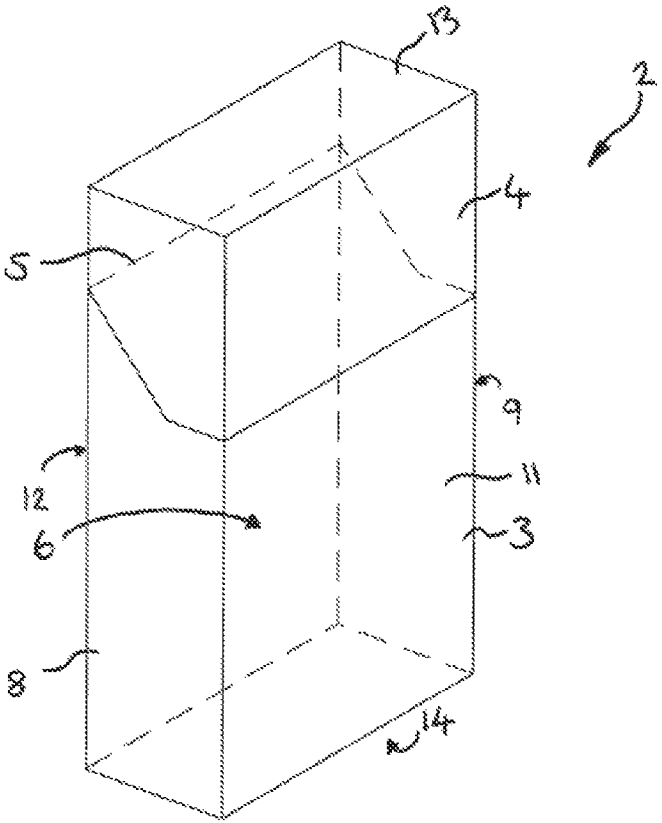
FIG. 3 shows an individual package of a collation of packages.

Referring briefly to FIG. 3, the package 2 may be, for example, but not limited to, a hinge lid pack, as illustrated. The package 2 comprises a container 3 and a lid 4 hingedly connected to the container 3 along a hinge line 5 in order to allow the package to be opened and closed. It will be appreciated that the container 3 forms a delivery system receiving space 6 in which delivery systems such as smoking articles or other tobacco industry products are received and stored. The delivery systems are accessible when the lid 4 is in an open position, and the delivery systems are retained in the delivery system receiving space 6 when the lid 4 is in a closed position. Other types of package, such as those known as clamshell or slide and shell, are also within the scope of the invention.

The package 2 comprises a pair of opposing first faces 11, 12, a pair of opposing second faces 8, 9, and a pair of opposing end faces 13, 14. The pair of opposing first faces 11, 12 are separated by opposing second faces 8, 9. In the present embodiment, the opposing first faces 11, 12 form major panels 11, 12 which make up the front and rear panels of the package 2. The front first face or major panel 11 may comprise a front container wall and a front lid wall. The rear first face or major panel 12 may comprise a rear container wall and a rear lid wall. In the present embodiment, the opposing second faces 8, 9 form minor walls 8, 9 which make up the side walls of the package 2. The second faces or side walls 8, 9 of the package 2 may comprise container side walls and lid side walls. The ends of the package 2 are closed by opposing end faces 13, 14 comprising a top end face 13 and a bottom end face 14. In the present embodiment, the top end face 13 may comprise a lid top wall and the bottom end face 14 may comprise a container bottom wall.

Referring now back to FIG. 1, it can be seen that the plurality of individual packages 2 for delivery systems which make up the collation 1 of packages 2 are arranged into rows. In the embodiment shown in FIG. 1, the collation 1 of packages 2 comprises a first row 16 and a second row 17. The first and second rows 16, 17 are adjacent one another.

In the present embodiment, the packages 2 are arranged into rows 16, 17 such that a second face 8, 9 of a package 2 faces a second face 8, 9 of an adjacent package 2 within the same row 16, 17. Furthermore, the packages 2 are arranged such that a first face 11, 12 of a package 2 in a row 16 faces a first face 11, 12 of a package 2 in an adjacent row 17. In addition, the packages 2 are arranged such that a second face 8, 9 of a package 2 at an end 18, 19 of each row 16, 17 and a first face 11, 12 of each package 2 along the rows 16, 17 are exposed.

However, it will be appreciated that in alternative embodiments, the packages 2 may be arranged such that a first face 11, 12 of a package 2 faces a first face 11, 12 of an adjacent package 2 within the same row 16, 17 or such that an end face 13, 14 of adjacent packages 2 within the same row 16, 17 face each other.

Figure 2:
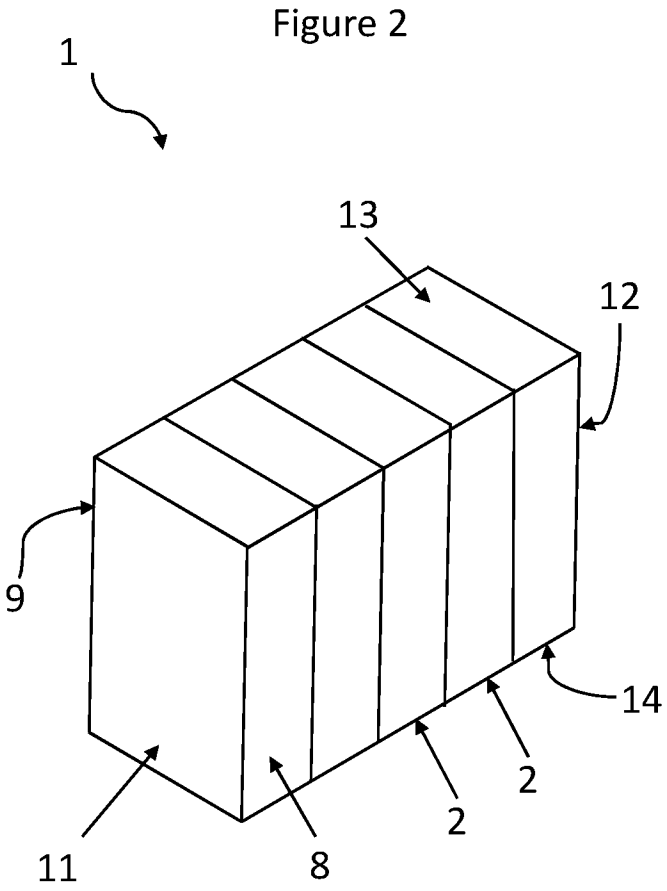

In the present embodiment, the collation 1 comprises two rows of five packages 2. However, it will be understood that in an alternative embodiment, the number of packages in a row may be different and the number of rows present may be different. For example, as shown in FIG. 2, the packages 2 may be collated in a single row wherein a first face 11, 12 of a package 2 faces a first face 11, 12 of an adjacent package in the row. In particular, the row may comprise five, six, seven, eight, nine or ten packages.

Each row 16, 17 has two ends 18, 19, as mentioned above. Each end 18, 19 of the rows 16, 17 comprise a free surface 21, 22. The free surface 21, 22 is formed by a second face 8, 9 of an individual package 2 which is located at the end 18, 19 of a row 16, 17. Therefore, the free surface 21, 22 formed by a second face 8, 9 of the package 2 at the end 18, 19 of the row 16, 17 does not face towards an adjacent package in the same row 16, 17. For example, in the present embodiment, the first row 16 of packages has an end 18 formed by the free surface 21 which is a second face 8 of the individual package 2 at the end 18 of the first row 16, and the second row 17 of packages has an end 19 formed by the free surface 22 which is a second face 9 of the individual package 2 at the end 19 of the second row 17.

Each package 2 within each row 16, 17 has an exposed first face 11, 12 which forms a free surface 23. The free surface 23 formed by a first face 11, 12 of a package 2 does not face towards a package 2 in an adjacent row.

Figure 4:
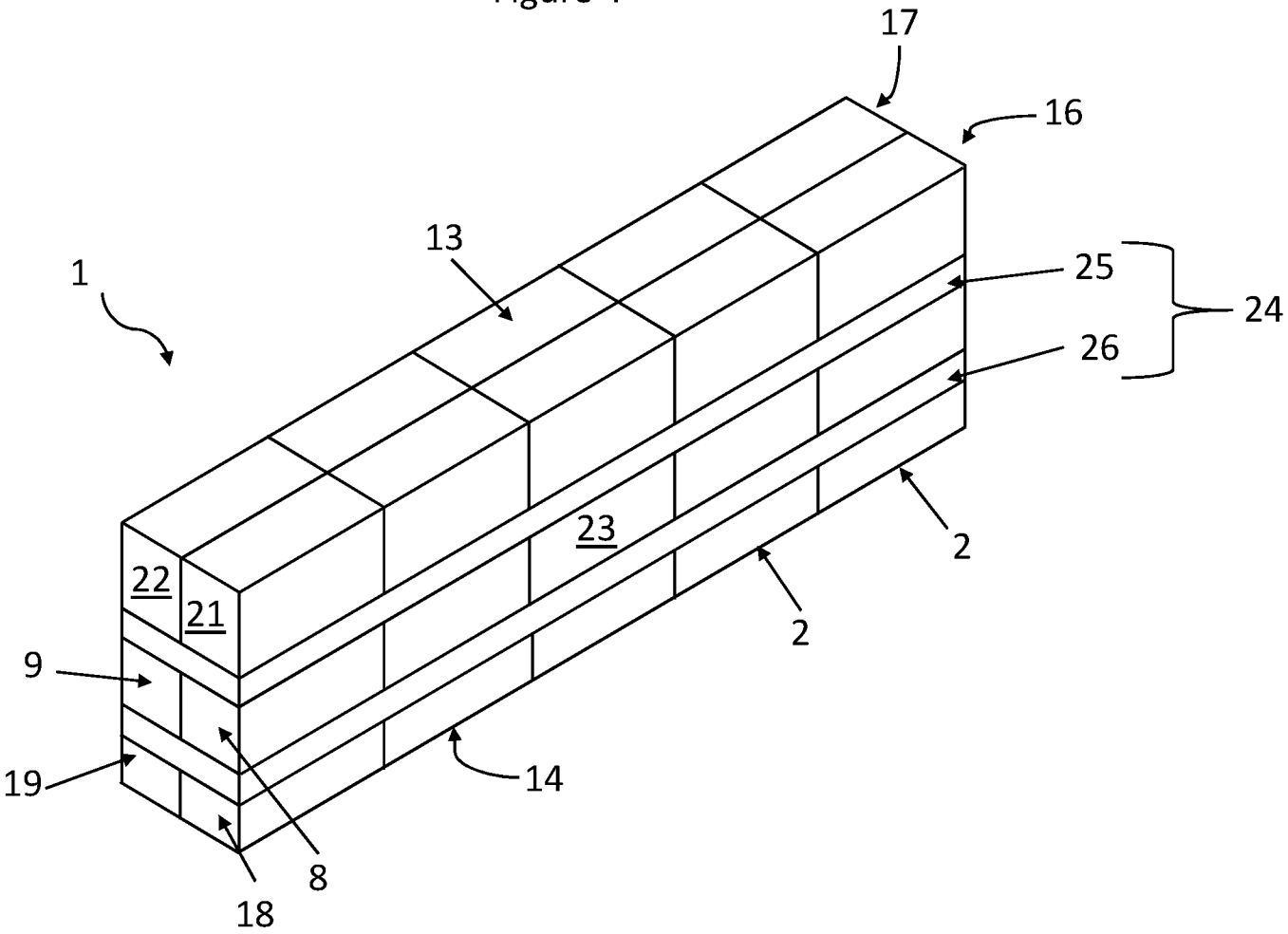
FIG. 4 shows a first embodiment of a collation of packages for delivery systems.

Referring now to FIG. 4, the collation 1 of packages 2 further comprises a plurality of bands 24 which extend about the packages 2 to hold the collation together. Each band 25, 26 is spaced from its adjacent band 25, 26 and extends over the exposed first face 11, 12 and the exposed second face 8, 9 of each package 2. In other words, each band extends over the free surfaces 21, 22, 23 of the packages 2.

As explained above, the pair of opposing end faces 13, 14 of the packages 2 comprises a top end face 13 and a bottom end face 14. The packages 2 of the collation 1 are arranged such that all of the top end faces 13 of the packages 2 lie in a first plane and all the bottom end faces of the packages 2 lie in a second plane, parallel to the first plane. Each of the bands 24 extend in a direction which is parallel to the first and second planes.

As illustrated in FIG. 4, the plurality of bands 24 comprises a first band 25 and a second band 26. The first band 25 is spaced from the first and second planes. Additionally, the second band 26 is spaced from the first and second planes. It is to be appreciated that the bands 24 may be located in any position in which they are spaced from the first and second planes.

Figure 5:
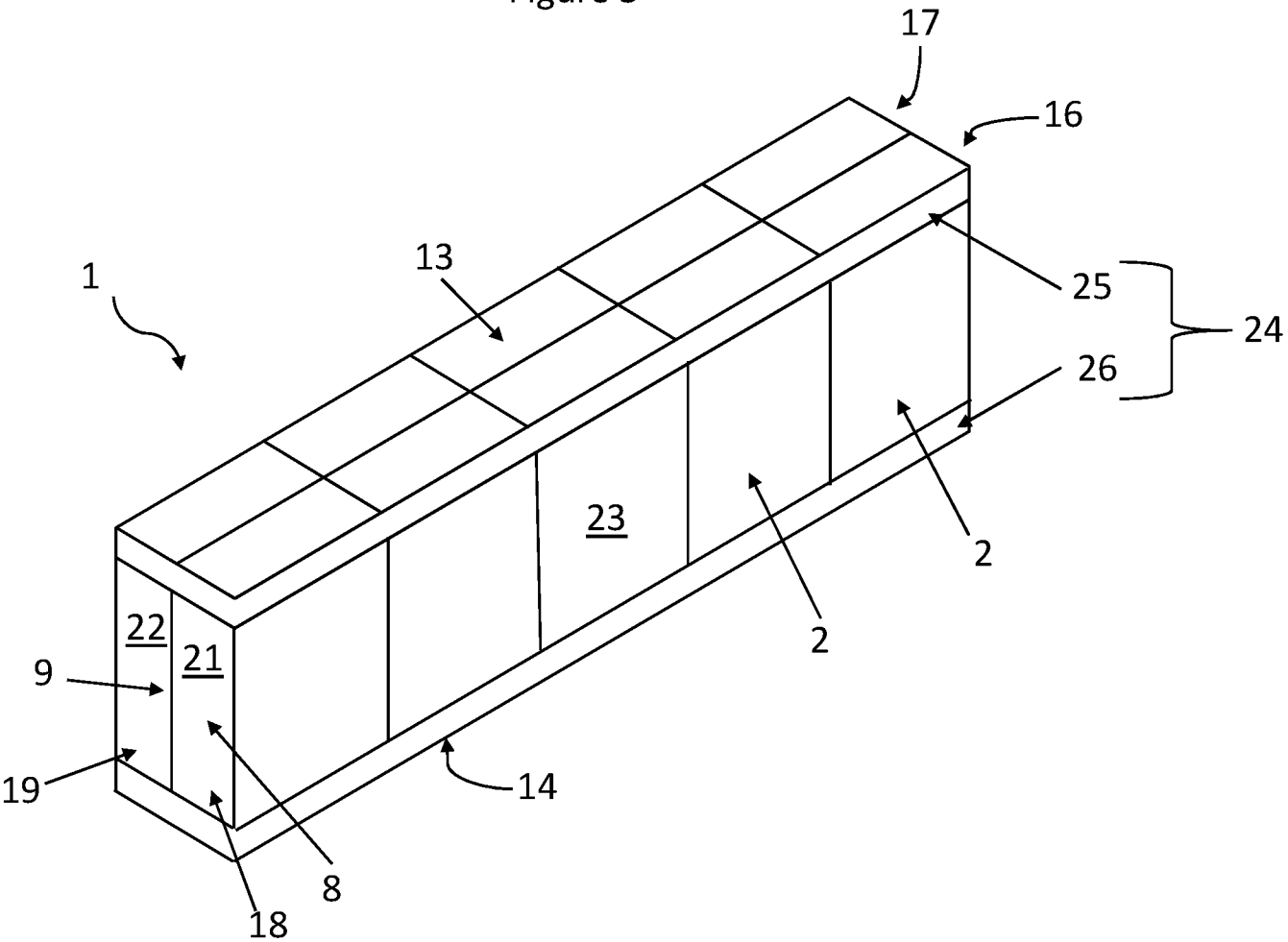
FIG. 5 shows a second embodiment of a collation of packages for delivery systems.

FIG. 5 illustrates an alternative embodiment of the collation of packages 2. As shown, the first band 25 is contiguous with the first plane. Additionally, the second band 26 is contiguous with the second plane.

It is to be appreciated that the positioning of the bands 24 is not limited to the embodiments shown. The bands 24 may be in any position where the bands 24 extend over the exposed first faces 11, 12 and exposed second faces 8, 9 of the packages 2 and in a direction parallel to the first and second planes defined by the top and bottom end faces 13, 14 of the packages 2. Furthermore, it is to be appreciated that the collation 1 is not limited to comprising two bands 24.

In another embodiment (not shown), the collation 1 comprises a third band located between the first and second bands 25, 26. Additionally, the collation 1 may comprise any number of bands 24. Having more bands around the collation of packages allows for an even distribution of pressure applied to the collation. Furthermore, the bands may be positioned around the collation of packages to not block information or communication on the packages. Here, more than two bands may be applied to the collation to ensure the collation is secure and to ensure all information or communication on the packages is visible to a consumer.

In another embodiment of the collation 1 of packages 2, each package 2 comprises a wrapper and a tear strip for removal of the wrapper by a consumer. In this embodiment, the plurality of bands 24 extend about the packages 2 such that they do not overlie the tear strips and therefore ensure that the bands 24 do not interfere with the tear strips.

The plurality of bands 24 extending around the packages 2 may also be equally spaced from one another.

The bands 24 may be endless bands. In order to remove an individual package 2 from the collation 1 of packages 2, a consumer may pull the endless bands 24 away from the collation 1 of packages 2 and slide a package 2 away from the collation 1. The endless bands 24 may be formed from a heat-sensitive material and shrunk using a heat-shrinking process in order to fit the bands 24 around the collation of packages 2.

Alternatively, the bands 24 may be strips or ribbons. The strips or ribbons may comprise a pressure-sensitive adhesive layer for releasable attachment to the collation 1 of packages 2. Pressure-sensitive adhesives are a type of non-reactive adhesive which forms a bond when pressure is applied to bond the adhesive with the adherend, instead of requiring a solvent, water, or heat to activate the adhesive. In some embodiments, the pressure sensitive adhesive may be based on an elastomer compounded with a tackifier, for example, a rosin ester. The elastomers may be based on acrylics which do not require a tackifier, or bio-based acrylate.

As opposed to comprising a complete layer of adhesive, the strips or ribbons may comprise an incomplete layer of adhesive or an adhesive pattern that reduces the intensity of adhesion to the packages. In other words, the strips or ribbons may have a lower total adhesive contact area with the packages, compared to a complete layer of adhesive, which results in an overall weaker adhesion of the strips or ribbons to the packages. This arrangement may be beneficial since a large adhesive contact area between the strips or ribbons and the packages may result in quality issues.

The strips or ribbons may comprise a region of overlap. Within the region of overlap, the strips or ribbons may be adhered to themselves with a peelable adhesive. A tip portion of the region of overlap can be treated to be adhesive free and form a pull tab. Therefore, a consumer can grasp the pull tab and remove the strips or ribbon from the collation 1 of packages 2. The strips or ribbons can then be reattached via the pressure-sensitive adhesive.

Alternatively, within the region of overlap, the strips or ribbons may comprise an area of relatively strong adhesive. For example, the strips or ribbons may be adhered to the packages with a relatively weaker adhesive and the strips or ribbons may be adhered to one another in the region of overlap with a relatively strong adhesive. Both the relatively strong and weak adhesives may be permanent or releasable adhesives. The strips or ribbons in the region of overlap may be aligned via a camera or sensor system. For example, a registration mark such as contrasting colours or UV ink may be used to align the strips or ribbons in the region of overlap.

Preferably, the plurality of bands 24 are formed from a transparent material. Therefore, the bands 24 do not obstruct important information or communication printed on the faces of the packages 2. For example, the bands 24 may be formed from monoaxially oriented polypropylene (MOPP). Alternatively, the bands 24 may be formed from polyethylene terephthalate (PET). The bands 24 may also be formed from PP, PE, PVC, HDPE, LDPE, PP derivatives and or Polyester. Furthermore, the material may be recycled, biodegradable or compostable.

The plurality of bands 24 have a width between 1.6 mm and 20 mm. Preferably, the bands 24 have a width of 8 mm.

Figure 6:
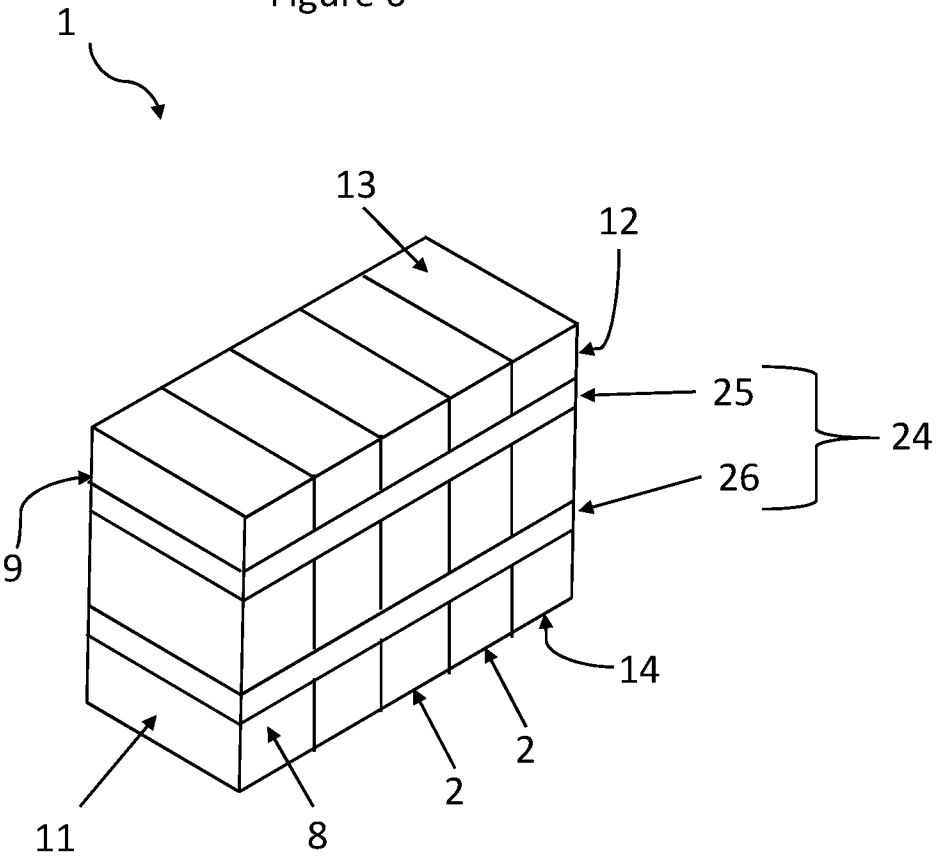
FIG. 6 shows another embodiment of a collation of packages for delivery systems.

FIG. 6 illustrates another embodiment of a collation of packages 2. Here the packages 2 are arranged in an alternative arrangement where the packages 2 are collated in a single row wherein a first face 11, 12 of a package 2 faces a first face 11, 12 of an adjacent package in the row. Similar to the embodiment shown in FIG. 4, the collation comprises a plurality of bands 24 which extend about the packages 2 to hold the collation together. Each band 25, 26 is spaced from its adjacent band 25, 26 and extends over the exposed first face 11, 12 and the exposed second face 8, 9 of each package 2. The first band 25 is spaced from the first and second planes. Additionally, the second band 26 is spaced from the first and second planes. It is to be appreciated that the bands 24 may be located in any position in which they are spaced from the first and second planes.

Alternatively, similar to the embodiment depicted in FIG. 5, the first band 25 may be contiguous with the first plane. Additionally, the second band 26 may be contiguous with the second plane.

It is to be appreciated that the above description of the plurality of bands 24 in relation to FIGS. 4 and 5 is also applicable to the collation shown in FIG. 6.

Figure 7:
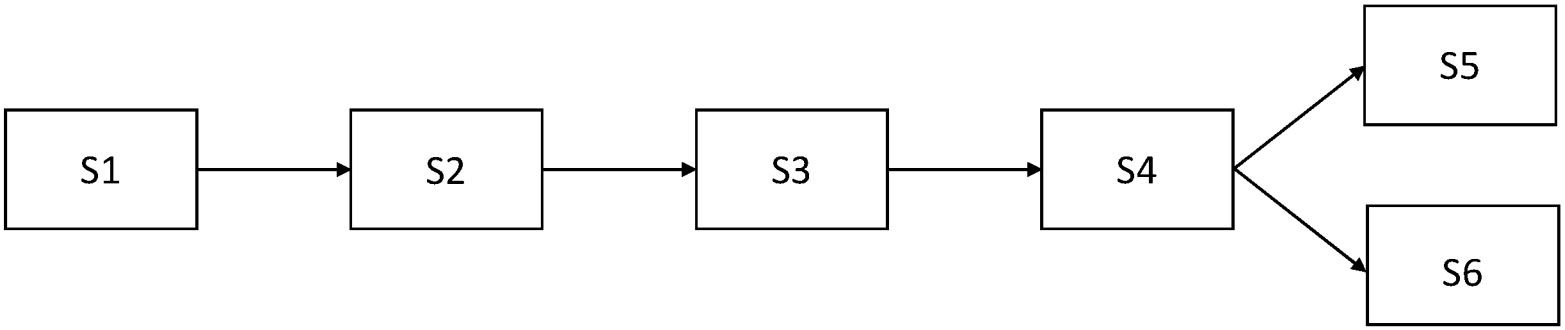
FIG. 7 shows a method of holding a collation of cuboid-shaped packages together.

FIG. 7 illustrates a method of holding a collation of cuboid-shaped packages together. The method comprises a first step S1 which is providing a collation of packages, each package comprising a pair of opposing first faces, a pair of opposing second faces and a pair of opposing end faces. The second step S2 involves arranging the packages in rows such that a second face of a package faces a second face of an adjacent package within the same row, and a first face of a package in a row faces a first face of a package in an adjacent row, a second face of a package at the end of each row, and a first face of a package in a row being exposed. The third step S3 is providing a plurality of bands and the fourth step S4 of the method comprises positioning each band so that it is spaced from its adjacent band and extends over the exposed first face, and exposed second faces, of each package.

Additionally, the method may comprise a further step S5. When each band is endless and formed from a heat-sensitive material, the method comprises heat shrinking each band once they have been positioned so as to extend over the exposed first and second faces.

Furthermore, the method may comprise an alternative step S6 to S5. When the plurality of bands are strips or ribbons, the method comprises attaching the strips or ribbons to the packages via an adhesive.

The various embodiments described herein are presented only to assist in understanding and teaching the claimed features. These embodiments are provided as a representative sample of embodiments only, and are not exhaustive and/or exclusive. It is also to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A collation of packages, each package of the collation being cuboid-shaped and comprising a pair of opposing first faces, a pair of opposing second faces and a pair of opposing end faces, wherein the packages are arranged in rows such that a second face of a package faces a second face of an adjacent package within the same row, and a first face of a package in a row faces a first face of a package in an adjacent row, a second face of a package at the end of each row, and a first face of each package in a row, being exposed;

a plurality of bands extending about the packages to hold the collation together;

wherein each band is spaced from its adjacent band and extends over the exposed first face and exposed second face, of each package; and wherein each package comprises a wrapper and a tear strip for removal of the wrapper, wherein the plurality of bands extend about said packages such that they do not overlie the tear strip.

2. The collation according to claim 1, wherein the pair of opposing end faces of each package comprises a top end face and a bottom end face, and wherein all the top end faces of the collation of packages lie in a first plane, and the bottom end faces of the collation of packages lie in a second plane, parallel to the first plane, and wherein each band of the plurality of bands extends parallel to said first and second planes.

3. The collation of packages according to claim 2, wherein the plurality of bands comprises a first band and a second band, said first band being spaced from said first and second planes, and wherein the second band is spaced from said first and second planes.

4. The collation of packages according to claim 2, wherein the plurality of bands comprises a first band and a second band, said second band being spaced from said first and second planes.

5. The collation of packages according to claim 2, wherein the plurality of bands comprises a first band and a second band, wherein the first band is contiguous with the first plane, and wherein the second band is contiguous with the second plane.

6. The collation of packages according to claim 2, comprising a third band between said first and second bands.

7. The collation of packages according to claim 1, wherein the plurality of bands are equally spaced from one another.

8. The collation of packages according to claim 1, wherein each band of the plurality of bands is endless.

9. The collation of packages according to claim 1, wherein the plurality of bands are strips or ribbons, and wherein the strips or ribbons comprise a pressure-sensitive adhesive layer for releasable attachment to the collation of packages.

10. The collation according to claim 9, wherein each strip or ribbon comprise a region of overlap.

11. The collation according to claim 10, wherein the strip or ribbon is adhered to itself with peelable adhesive in the region of overlap, a tip portion of the region of overlap being adhesive free to form a pull tab.

12. The collation according to claim 1, wherein at least one of the plurality of bands is formed from a transparent material.

13. The collation according to claim 1, wherein at least one of the plurality of bands is formed from MOPP or PET.

14. The collation according to claim 1, wherein the plurality of bands each have a width between 1.6 mm and 20 mm, preferably 5 mm to 15 mm, preferably around 8 mm.

15. The collation according to claim 1, wherein the first face of each package is a major face, and the second face of each package is a minor face.

16. A collation of packages, each package of the collation being cuboid-shaped and comprising a pair of opposing first faces, a pair of opposing second faces and a pair of opposing end faces, wherein the packages are arranged in a row such that a first face of a package faces a first face of an adjacent package in the row, a first face of a package at the end the row, and a second face of each package in the row, being exposed;

a plurality of bands extending about the packages to hold the collation together;

wherein each band is spaced from its adjacent band and extends over the exposed first face and exposed second face, of each package; wherein each band is spaced from its adjacent band and extends over the exposed first face and exposed second face, of each package.

17. A method of retaining packages together in a collation, the method comprising:

providing a collation of cuboid-shaped packages, each package comprising a wrapper and a tear strip for removal of the wrapper, each package also comprising a pair of opposing first faces, a pair of opposing second faces and a pair of opposing end faces, arranging the packages in rows such that a second face of a package faces a second face of an adjacent package within the same row, and a first face of a package in a row faces a first face of a package in an adjacent row, a second face of a package at the end of each row, and a first face of a package in a row being exposed;

providing a plurality of bands; and positioning each band so that it is spaced from its adjacent band and extends over the exposed first face, and the exposed second faces, of each package and such that the plurality of bands extend about said packages such that they do not overlie the tear strip.

18. The method according to claim 17, wherein each band is endless and is formed from a heat-sensitive material, the method comprising heat shrinking each band once they have been positioned so as to extend over the exposed first faces and exposed second faces.

19. The method according to claim 17, wherein the plurality of bands are strips or ribbons and the method comprises attaching the strips or ribbons to the packages via an adhesive.

* * * * *